US005614979A

United States Patent [19]

Itoh

[11] Patent Number: 5,614,979

[45] Date of Patent: Mar. 25, 1997

[54] REPLENISHING DEVICE AND METHOD OF DETECTING FAILURES PRODUCED THEREIN

[75] Inventor: Koji Itoh, Kanagawa, Japan

[73] Assignee: Fuji Photo Film Co., Ltd., Kanagawa, Japan

[21] Appl. No.: 460,033

[22] Filed: Jun. 2, 1995

[30] Foreign Application Priority Data

Sep. 12, 1994 [JP] Japan ..... 6-217485
Sep. 12, 1994 [JP] Japan ..... 6-217486

[51] Int. Cl.[6] ..... G03D 13/00

[52] U.S. Cl. ..... 396/578; 396/626

[58] Field of Search ..... 354/298, 322–324; 134/64 R, 64 P, 122 P, 122 R; 222/86, 83; 366/153, 167, 177; 340/450.3, 450.1, 450.2, 450

[56] References Cited

U.S. PATENT DOCUMENTS

| | | | |
|---|---|---|---|
| Re. 30,610 | 5/1981 | Gacki et al. | 366/153 |
| 5,023,643 | 6/1991 | Lynch et al. | 354/324 X |
| 5,151,731 | 9/1992 | Yamada et al. | 354/324 |
| 5,179,405 | 1/1993 | Osada et al. | 354/324 |
| 5,298,881 | 3/1994 | Bowman | 340/450.1 |
| 5,307,107 | 4/1994 | Nozawa et al. | 354/324 |
| 5,416,551 | 5/1995 | Ishikawa et al. | 354/298 |

*Primary Examiner*—D. Rutledge
*Attorney, Agent, or Firm*—Sughrue, Mion, Zinn, Macpeak & Seas

[57] ABSTRACT

A replenishing device is provided which comprises a replenishing tank for temporarily storing a replenishing processing chemical therein, a replenisher for supplying the replenishing processing chemical from the replenishing tank to a processing bath to replenish the processing bath with the replenishing processing chemical, a sensor for detecting whether a replenishing processing chemical of a quantity exceeding a first specified quantity remains within the replenishing tank, a display unit capable of displaying instructions for the supply of the replenishing processing chemical to the replenishing tank thereon, and a control device for causing the display unit to display the instructions when the control device judges, based on a quantity of a replenishing processing chemical added to the processing bath after the sensor has detected that a remaining quantity of the replenishing processing chemical in the replenishing tank has been brought to a level that is less than the first specified quantity, that the remaining quantity thereof is less than a second specified quantity. Thus, the replenishing processing chemical can be supplied to the replenishing tank before the replenishing processing chemical in the replenishing tank is completely empty, thereby making it possible to reduce interruptions of development processing and improve work efficiency.

20 Claims, 6 Drawing Sheets

REPLENISHING DEVICE AND METHOD OF DETECTING FAILURES PRODUCED THEREIN

BACKGROUND OF THE INVENTION

1. Field of the Invention:

The present invention relates to a replenishing device for replenishing replenishing tanks with replenishing processing chemicals upon starting development processing or the like and to a replenishing device capable of detecting failures of replenishing means which replenish replenishing processing chemicals into processing baths and a method for detecting failures in the replenishing device, both of which can be applied to, for example, a printer-processor which is a combination of a photographic printer and a processor.

2. Description of the Related Art:

A printer-processor is a so-called "mini-laboratory" and is used in a developing, printing and enlargement (DPE) shop or the like. In the printer-processor, a printer unit, which prints/exposes images recorded on a negative film onto photographic paper, and a processor unit, which effects development processing of the printed and exposed photographic paper, are combined into a single unit. By simply setting an elongated photographic paper at the printer-processor, the photographic paper can be automatically conveyed to the printer unit and the processor unit and processed thereat.

In the printer unit of the printer-processor, the images recorded on the negative film are enlarged to selected predetermined sizes and are printed on photographic paper. The photographic paper on which the images of the negative film have been printed is successively conveyed to the processor unit where the negative film is subjected to development processing so that the images are finished as photographic prints.

Further, a plurality of processing baths for respectively performing processes such as development, bleaching/fixing and washing are provided in the processor unit. Replenishing tanks for respectively storing replenishing processing solutions therein are coupled to their corresponding processing baths through replenishing pumps. By respectively feeding the replenishing processing solutions into the processing baths from the replenishing tanks via the replenishing pumps, the respective processing baths are respectively replenished with the replenishing processing solutions to recover depletion of processing solutions within the processing baths and maintain the processing solutions in a stable state.

In general, a liquid level detector such as a float switch or the like is provided near the bottom of a replenishing tank. When a level of replenishing processing solution is detected by the level detector, a system judges that there is no replenishing processing solution and immediately produces an alarm to tell an operator to put replenishing processing solution into the replenishing tank.

With recent advances, the remaining quantity of replenishing processing solution in a replenishing tank is now recognized by attaching a rotary encoder or the like to a rotatable shaft of a replenishing pump and detecting the quantity of replenishing processing solution fed into a processing bath from the replenishing tank. If it is judged that there is no replenishing processing solution, an alarm is sounded to immediately tell the operator to put the replenishing processing solution into the replenishing tank. Therefore, development processing executed by a printer-processor must be discontinued each time the alarm sounds, thereby causing a reduction in work efficiency.

On the other hand, since the number-of-revolutions detector such as the rotary encoder or the like is expensive and is contrary to a demand for a reduction in the manufacturing cost of the printer-processor, non-detection of the number of revolutions of a replenishing pump was investigated. It has therefore been considered that the remaining quantity of replenishing processing solution in a replenishing tank be recognized based on an estimated value indicative of the quantity of replenishing processing solution fed into a processing bath without directly detecting the number of revolutions of the replenishing pump.

However, if the supply of the replenishing processing solution to the processing bath from the replenishing tank is stopped due to failure in the replenishing pump, then the failure cannot be detected. It is therefore necessary to provide a means for detecting such a failure at an early stage.

SUMMARY OF THE INVENTION

With the foregoing in view, it is therefore an object of the present invention to provide a replenishing device capable of reducing interruptions of development processing and providing an improvement in work efficiency.

It is another object of the present invention to provide a replenishing device capable of detecting failures in a replenishing pump at low cost and to a method of detecting such failures in the replenishing device.

According to one aspect of the present invention, there is provided a replenishing device comprising a replenishing tank for temporarily storing therein a replenishing processing chemical available for replenishing development processing in a processing bath; replenishing means for replenishing a replenishing processing chemical to the processing bath from the replenishing tank so as to replenish the processing bath with a replenishing processing chemical commensurate in quantity with a processing chemical used within the processing bath; a sensor for detecting whether a replenishing processing chemical corresponding to a quantity or volume exceeding a predetermined first specified quantity remains within the replenishing tank; a display unit capable of displaying instructions for supplying the replenishing processing chemical to the replenishing tank; and a control device for allowing the display unit to display the instructions thereon when the control device judges, based on a quantity of a replenishing processing chemical added to the processing bath after the sensor has detected that a residual replenishing processing chemical has been brought to less than the first specified quantity, that the remaining quantity of replenishing processing chemical in the replenishing tank is less than a second specified quantity predetermined so as to become less than the first specified quantity.

The replenishing device can bring about the following effects.

The replenishing means supplies the replenishing processing chemical temporarily stored in the replenishing tank to the processing bath so as to refill the processing bath with the processing chemical corresponding to the quantity of the processing chemical used and depleted within the processing bath. Further, the sensor detects whether or not the replenishing processing chemical commensurate with the quantity exceeding the predetermined first specified quantity remains within the replenishing tank.

Further, when the control device judges, based on the quantity of the replenishing processing chemical added to the processing bath after the sensor has detected that the replenishing processing chemical has been brought to a level that is less than the first specified quantity, that the residual replenishing processing chemical is less than the predetermined second specified quantity, the control device allows the display unit to display the instructions for the supply of the replenishing processing chemical to the replenishing tank thereon.

Thus, the replenishing processing chemical can be supplied to the replenishing tank before the replenishing processing chemical in the replenishing tank is completely empty. Therefore, the replenishing processing chemical may be supplied to the replenishing tank after the completion of one day's development processing or before the initiation of the one day's development processing. Thus, interruptions of the development processing is reduced and work efficiency is improved.

In the present invention, the control device preferably allows the display unit to display the instructions for the supply of the replenishing processing chemical to the replenishing tank upon starting development processing when the control device determines that the remaining quantity of replenishing processing chemical in the replenishing tank is less than the second specified quantity predetermined as a normal daily processing quantity or volume. Since the replenishing device can judge upon initiation of development processing whether or not the residual replenishing processing chemical is less than the one-day, processing quantity, it is unnecessary to supply the replenishing processing chemical to the replenishing tank while development processing is interrupted during development processing.

In the present invention as well, the sensor is preferably provided so that the first specified quantity is set as a value larger than the normal, one-day processing quantity. Since a replenishing processing chemical corresponding to a quantity or volume larger than the one day's processing quantity remains when the remaining quantity of replenishing processing chemical supplied to the replenishing tank has been detected by the sensor, the replenishing device can set the second specified quantity to a quantity defined as the normal, one-day processing quantity.

Further, in the present invention, the control device preferably causes the display unit to display the instructions for the supply of the replenishing processing chemical to the replenishing tank when the control device stores the total quantity of replenishing chemical supplied from the replenishing means, recognizes the remaining quantity of replenishing processing chemical and judges that the residual quantity of replenishing processing chemical is less than the second specified quantity predetermined so as to become less than the first specified quantity. Since the control device stores the total quantity of replenishing processing chemical supplied from the replenishing means and recognizes the remaining quantity of replenishing processing chemical, the replenishing device can accurately judge the quantity of the replenishing processing chemical fed to the processing bath and reduce errors in measurement of the quantity of the replenishing processing chemical supplied to the processing bath.

According to another aspect of the present invention, there is provided a replenishing device comprising a replenishing tank for temporarily storing therein a replenishing processing chemical available for replenishing developing processing in a processing bath; replenishing means for supplying a replenishing processing chemical to the processing bath from the replenishing tank so as to replenish the processing tank with a replenishing processing chemical of a quantity required to recover a processing chemical used and depleted within the processing bath; a sensor capable of detecting that a remaining quantity of the replenishing processing chemical in the replenishing tank has reached a predetermined first specified quantity; a display unit capable of displaying non-detection of a reduction in the replenishing processing chemical and instructions for supplying the replenishing processing chemical to the replenishing tank; and a control device for allowing the display unit to display the non-detection of the reduction in the replenishing processing chemical thereon where the sensor does not detect the remaining quantity of the replenishing processing chemical when the control device estimates, based on a quantity of a replenishing processing chemical for supplementing depletion of a processing chemical according to a quantity of a processing chemical for development processing of a photosensitive material in the processing bath, that the remaining quantity of the replenishing processing chemical is less than the first specified quantity and for allowing the display unit to display the instructions thereon when the control device estimates, based on a quantity of a subsequent replenishing processing chemical for supplementing depletion of the processing chemical according to a quantity of a processing chemical for development processing of the photosensitive material in the processing bath, that the remaining quantity of the replenishing processing chemical in the replenishing tank is less than a second specified quantity predetermined so as to become less than the first specified quantity.

The replenishing device can bring about the following effects.

The replenishing means delivers the replenishing processing chemical temporarily stored in the replenishing tank to the processing bath so that the replenishing processing chemical is refilled based on the quantity of the replenishing processing chemical for supplementing the depletion of the processing chemical according to the quantity of the processing chemical for development processing of the photosensitive material in the processing bath. With this replenishment, the sensor can normally detect that the remaining quantity of the replenishing processing chemical in the replenishing tank has reached a level that is less than the predetermined first specified quantity.

On the other hand, when the replenishing means is faulty and the sensor does not detect the remaining quantity of replenishing processing chemical when the control device estimates that the remaining quantity of replenishing processing chemical reaches less than the first specified quantity, the control device allows the display unit to display the non-detection of the reduction in the replenishing processing chemical. Accordingly, an operator can recognize that the replenishing processing chemical has not yet been supplied to the processing bath due to failure of the replenishing means.

Further, when the control device estimates that the remaining quantity of the replenishing processing chemical in the replenishing tank is less than the second specified quantity, the control device causes the display unit to display the instructions for the supply of the replenishing processing chemical to the replenishing tank. Thus, the replenishing processing chemical is supplied to the replenishing tank in accordance with the instructions for the supply of the replenishing processing chemical to the replenishing tank. When, however, the replenishing means is faulty, it can be recognized that there is a failure of the replenishing means because of overflow of the replenishing processing chemical from the replenishing tank.

On the other hand, even if the replenishing processing chemical does not overflow the replenishing tank even though the replenishing means is faulty, the sensor does not detect the remaining quantity of replenishing processing chemical after the supply of the replenishing processing chemical to the replenishing tank. Therefore, the display unit displays the non-detection of the reduction in the replenishing processing chemical to enable the operator to recognize that the replenishing processing chemical is not yet supplied to the processing bath due to the failure of the replenishing means in the same manner as described above.

Thus, the failure of the replenishing means can be detected early at low cost without using a number-of-revolutions detector such as an expensive rotary encoder or the like.

According to a further aspect of the present invention, there is provided a method of detecting failures in a replenishing device employing the method therein, for supplying a replenishing processing chemical from a replenishing tank storing the replenishing processing chemical therein to a processing bath by replenishing means so as to replenish the processing bath with a replenishing processing chemical commensurate with a quantity for recovering depletion of a processing chemical used within the processing bath, which comprises steps of detecting, based on a quantity of a replenishing processing chemical for supplementing depletion of a processing chemical according to a quantity of a processing chemical for development processing of a photosensitive material in the processing bath, whether the replenishing processing chemical stored in the replenishing tank is reduced to less than a first specified quantity; and displaying information about a residual replenishing processing chemical in the replenishing tank, which is reduced to less than a second specified quantity when it is estimated, based on a quantity of a subsequent replenishing processing chemical for supplementing depletion of a processing chemical according to a quantity of a processing chemical for development processing of the photosensitive material in the processing bath, that the remaining quantity of replenishing processing chemical is less than the second specified quantity predetermined so as to become less than the first specified quantity.

The method can bring about the following effects.

It is possible to detect based on the quantity of the replenishing processing chemical for supplementing depletion of the processing chemical according to the quantity of the processing chemical for development processing of the photosensitive material in the processing bath, whether the replenishing processing chemical in the replenishing tank is reduced to a level that is less than the first specified quantity. Therefore, an operator can confirm a failure of the replenishing means due to the fact that the replenishing processing chemical has not been supplied to the processing bath.

When it is estimated based on the quantity of the processing chemical used within the processing bath that the remaining quantity of the replenishing processing chemical in the replenishing tank is less than the second specified quantity, information about the remaining quantity brought to less than the second specified quantity is displayed. Therefore, the replenishing processing chemical is supplied to the replenishing tank in accordance with the information. At this time, the operator can recognize the failures in the replenishing means due to the overflow of the replenishing processing chemical from the replenishing tank.

On the other hand, even when it is judged based on the remaining quantity of the replenishing processing chemical in the replenishing tank that the replenishing processing chemical does not overflow the replenishing tank even though the replenishing means is faulty, a reduction in the replenishing processing chemical cannot be detected after the replenishing processing chemical has been supplied to the replenishing tank. Accordingly, the failure of the replenishing means can be recognized owing to the fact that the replenishing processing chemical has not been supplied to the processing bath.

Thus, the failure of the replenishing means can be detected early at low cost without using a number-of-revolutions detector such as an expensive rotary encoder or the like.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

A printer-processor in which one embodiment of a replenishing device according to the present invention is employed, is shown in FIGS. 1 through 6. The present embodiment will be described below with reference to FIGS. 1 through 6.

Figure 1:
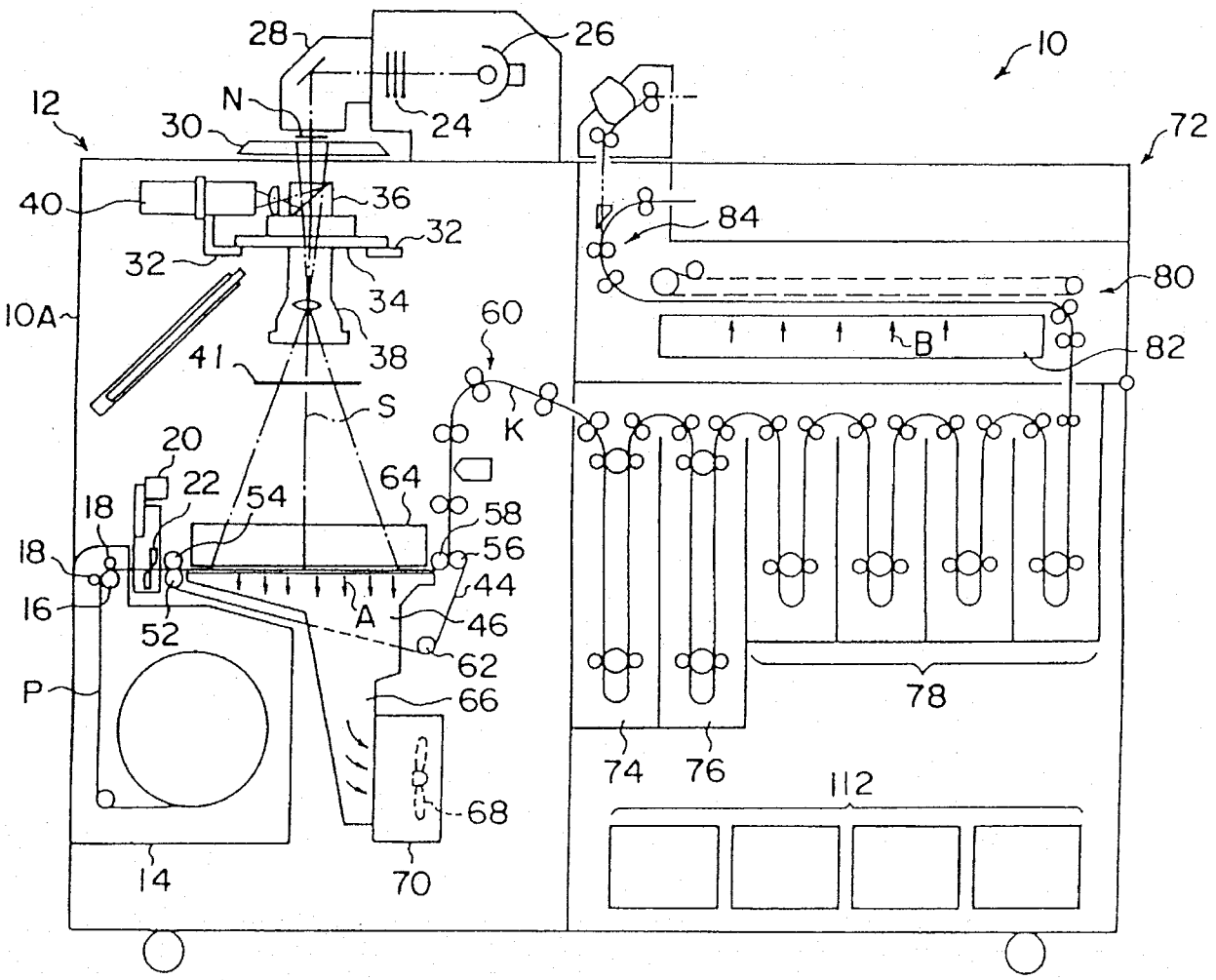
FIG. 1 is a view schematically showing the structure of a printer-processor to which one embodiment of the present invention is applied.
Figure 2:
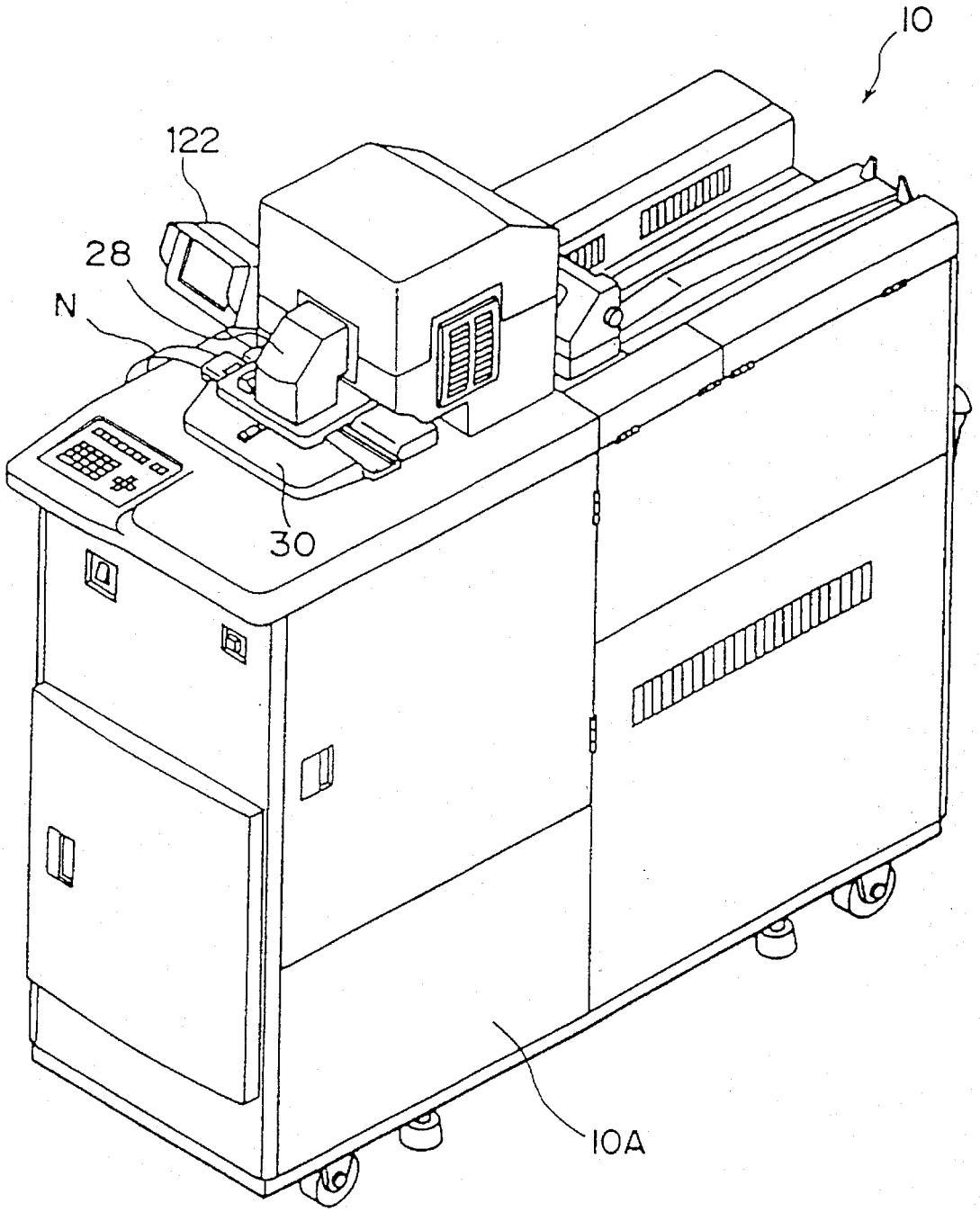
FIG. 2 is a perspective view showing the printer-processor shown in FIG. 1.

FIG. 1 is a schematic view showing a printer-processor 10 which is a photographic printer employed in one embodiment of the present invention. FIG. 2 is a perspective view of the printer-processor 10 shown in FIG. 1. A photographic printing portion 12, which constitutes a printer unit of the printer-processor 10, has a structure in which a paper magazine 14 with photographic paper P used as a photosensitive material accommodated therein can be loaded.

A drive roller 16 around which a portion adjacent to the leading end of the photographic paper P is wound, is rotatably supported on the left-upper side of the paper magazine 14 as seen in FIG. 1. The drive roller 16 is rotated in response to the driving force of an unillustrated motor provided within the photographic printing portion 12. A pair of nip rollers 18 is provided at a position opposite to the drive roller 16 with the photographic paper P being nipped therebetween. The photographic paper P is nipped between the drive roller 16 and the nip rollers 18. The drive roller 16 then conveys the photographic paper P to the inside of the photographic printing portion 12.

On the other hand, a cutter 22 formed by a pair of vertically-extending blades and operated by a motor 20 is provided within the photographic printing portion 12. The photographic paper P which is withdrawn from the paper magazine 14 is immediately cut by the cutter 22.

A support table 46 whose upper surface is formed along the horizontal direction (right and left directions as seen in FIG. 1), is provided on the right side of the cutter 22 as seen in FIG. 1, i.e., on the downstream side of the photographic paper P as seen in the direction in which the photographic paper P is conveyed. A winding roller 52 around which an endless belt 44 is wound, is disposed along the horizontal direction (i.e., the direction normal to the paper as seen in FIG. 1) between the support table 46 and the cutter 22. A nip roller 54 for nipping the endless belt 44 between the nip roller 54 and the winding roller 52 is provided on the upper side of the winding roller 52.

A guide roller 56 on which the endless belt 44 is wound, is provided on the downstream side of the support table 46 as seen in the direction in which the photographic paper P is conveyed. A press roller 58 whose lower surface becomes substantially identical in height to the upper surface of the winding roller 52, is provided at a position adjacent to the guide roller 56. The press roller 58 presses the outer periphery of the endless belt 44.

Namely, the pressed endless belt 44 is shaped in the form of an S letter as shown in FIG. 1. Further, the endless belt 44 is wound around a tension roller 62 on the lower side of the guide roller 56 so as to form an inverse-triangular travel locus. Thereafter, the guide roller 56 is driven and rotated by the driving force generated from the unillustrated motor so that the endless belt 44 is rotated in a clockwise direction as seen in FIG. 1.

On the other hand, the endless belt 44 has a plurality of small through-holes (not shown) defined therein over the entire region thereof. A plurality of through-holes (not shown) are defined in the upper surface of the support table 46 on which a part of the endless belt 44 is placed, so as to correspond to the small through-holes defined in the endless belt 44. Further, the support table 46 has an inner portion defined in hollow form. A pair of communication ducts 66 (only one of which is shown in FIG. 1) formed so as to correspond to transversely-extending ends of the endless belt 44 is connected to the support table 46. The communication ducts 66 bypass the endless belt 44 which passes through the lower side of the support table 46, so as to reach a position below the endless belt 44, followed by coupling to a fan box 70 provided with a suction fan 68.

As shown in FIG. 1, an easel device 64 is provided above the endless belt 44 which moves along the support table 46. When an image with edges is exposed onto the photographic paper P, the periphery of the photographic paper P is covered with an unillustrated moving part provided within the easel device 64.

Further, a light diffusion box 28 is provided at a position which is outside a casing 10A that forms an outer frame of the printer-processor 10 and which is set upright above the easel device 64. A CC filter 24 made of three filters which are cyan (C), magenta (M) and yellow (Y) each inserted into an optical path and movable so as to change a filtering amount, is disposed next door on the right side of the light diffusion box 28. Thus, a light beam emitted from a light source 26 provided adjacent to the CC filter 24 passes through the CC filter 24 and is then bent and falls perpendicularly while being diffused by the light diffusion box 28. The light beam is transmitted through a negative film N on a negative carrier 30 placed on the upper surface of the casing 10A.

Further, guide rails 32 provided within the photographic printing portion 12 support the support table 34 so that the support table 34 is movable in the horizontal direction (i.e., in the direction normal to the paper as seen in FIG. 1). A prism 36 and a zoom lens 38 are respectively attached to the support plate 34 so as to be disposed in the optical axis S of the light beam.

Accordingly, the light beam, which has passed through the negative film N and serves as exposure light, passes through the prism 36. Thereafter, the light beam passes through the zoom lens 38 which is capable of changing enlargement magnification to form images on the negative film N on photographic paper P which is disposed below the easel device 64.

A density measuring unit 40 comprised of a color filter and a photosensor such as a CCD or the like, for measuring the density of the negative film N is provided within the photographic printing portion 12. The light beam bent in the horizontal direction by the prism 36 is conveyed to the density measuring unit 40. The density measuring unit 40 is electrically connected to an unillustrated controller, which sets an exposure correction value at the time of exposure based on data measured by the density measuring unit 40 and data inputted via a keyboard by an operator.

Further, a black shutter 41 for passing therethrough the light beam whose color and intensity are dimmed by the CC filter 24 and which passes through the negative film N, so as to expose images on the negative film N onto photographic paper P for a predetermined time, is provided on the optical path between the zoom lens 88 and the easel device 64.

Since the photographic printing portion 12 is constructed as described above, the photographic paper P delivered from the paper magazine 14 is cut to a desired length by the cutter 22 and is then placed on the endless belt 44, after which it is conveyed to an image printing position corresponding to a position on the optical axis S of the exposure light. Further, the exposure light emitted from the light source 26 is sent to the photographic paper P through the prism 36 and the zoom lens 88 or the like. When the black shutter 41 is held open for the predetermined time, the exposure light reaches the photographic paper P so as to print the images recorded on the negative film N onto the photographic paper P. A portion of the photographic paper P onto which the images have been printed, is obtained as an image portion.

At this time, air in the support table 46 is released from within a loop of the endless belt 44 to the transversely-extending ends of the endless belt 44 via the communication ducts 66 and is sucked by the suction fan 68 so as to be blown to the outside. Therefore, the inside of the support table 46 is brought to negative pressure. The negative pressure is applied to the photographic paper P on the endless belt 44 via the through-holes defined in the support table 46 and the small through-holes defined in the endless belt 44 so that portions of the photographic paper P are sucked into the endless belt 44 as indicated by arrow A in FIG. 1. Thus, since the portions of photographic paper P are sucked into the endless belt 44 without being simply placed on the endless belt 44, the photographic paper P is reliably conveyed by the endless belt 44 and is horizontally disposed at the image printing position.

Further, the photographic paper P on which the images have been exposed, is held between the guide roller 56 and the press roller 58 and a photographic-paper conveying direction is changed from the horizontal direction to the vertical direction to feed the photographic paper P in the vertical direction. Thereafter, the photographic paper P is conveyed to a processor unit 72 for applying development, bleaching/fixing, washing and drying to the photographic paper P through a conveying path 60 formed by a plurality of pairs of rollers as represented by a path K showing a path for conveying the photographic paper P.

Thus, the processing for exposing one-frame images on the negative film N onto the photographic paper P is completed. By repeating such processing, the photographic paper P, which has been subjected to the above processing, is successively conveyed to the processor unit 72 one by one.

A developer is stored in a developing bath 74 provided within the processor unit 72. The photographic paper P is immersed into the developer so as to subject it to development. The developed photographic paper P is next conveyed to a bleaching/fixing tank 76 provided adjacent to the developing bath 74. The bleaching/fixing tank 76 contains a bleaching and fixing liquid therein. The photographic paper P is immersed into the bleaching and fixing liquid so as to subject it to bleaching and fixing. The photographic paper P, which has been subjected to the bleaching and fixing process, is conveyed to a washing unit 78 adjacent to the bleaching/fixing tank 76. The washing unit 78 is made up of a plurality of washing tanks with washing water stored therein. The photographic paper P is immersed into the washing water contained in the washing tanks so as to subject it to a washing process.

The photographic paper P, which has been subjected to the washing process, is conveyed to a driving unit 80 provide above the washing unit 78. In the drying unit 80, the photographic paper P is subjected to and dried by hot air blown along the direction indicated by arrow B from a chamber 82 disposed on the lower side of the path for conveying the photographic paper P.

A conveying path 84 formed by a plurality of pairs of rollers is provided on the downstream side of the drying unit 80 as seen in the direction in which the photographic paper P is conveyed. Therefore, the photographic paper P, which has been subjected to the drying process and successively ejected from the drying unit 80, is discharged to the outside of the printer-processor 10 while being held by the plurality of pairs of rollers so as to be stacked on one another.

Incidentally, a developing replenisher, a bleaching/fixing replenisher and a washing replenisher are respectively supplied to the developing bath 74, the bleaching/fixing tank 76 and the washing tanks from a plurality of replenishing tanks 112 provided within the processor unit 72 so that they are replenished with corresponding replenishers.

Figure 3:
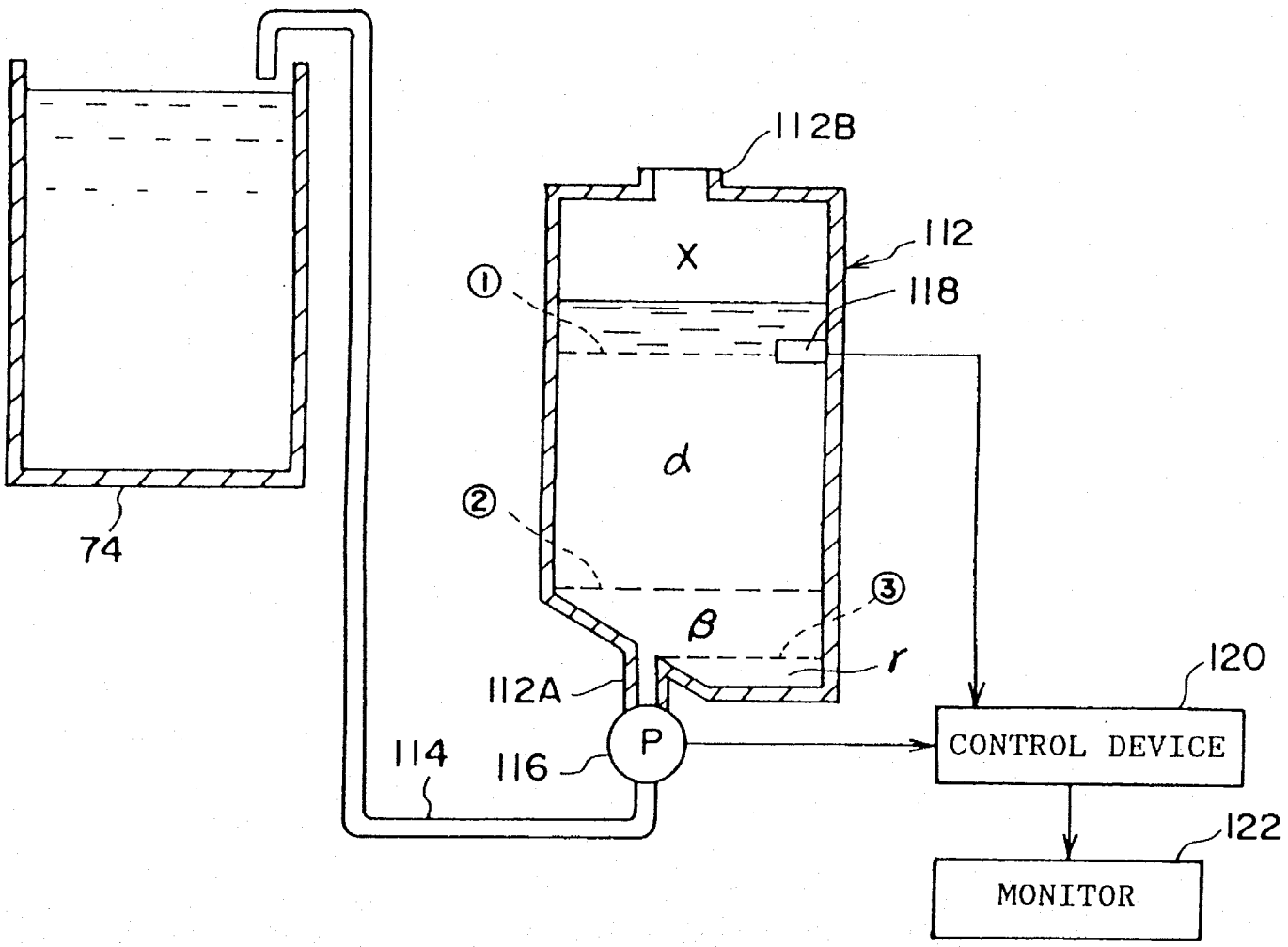
FIG. 3 is a view schematically illustrating the structure of a replenishing device according to one embodiment of the present invention and is a view showing a state in which a liquid level is located above a dotted line ①.

As shown in FIG. 3, a structure for replenishing the developing bath 74 with liquid will now be described taking the developing bath 74 of the respective processing baths as an example.

The developing bath 74 is coupled to a discharge port 112A provided at a position near a lower portion of each of the replenishing tanks 112 via a pipe 114. In order to replenish a developer which was used and hence depleted by subjecting the photographic paper P in the developing bath 74 to development by a predetermined quantity and the activation of the developer, a developing replenisher, which serves as a refill or replenishing liquid, is temporarily stored in the replenishing tank 112. A replenishing pump 116, which serves as a replenishing means for supplying a developing replenisher to the developing bath 74 from the replenishing tank 12, is provided between one end of the discharge port 112A and one end of the pipe 114. The replenishing pump 116 has a rotatable shaft which is rotated by an AC motor (not shown).

Namely, the developing replenisher is temporarily stored in the corresponding replenishing tank 112 in order to refill the developing replenisher based on a predetermined quantity to be refilled, for supplementing depletion of the developer according to the quantity of developer for development processing of the photographic paper P to thereby recover depletion of the used developer.

Further, a float switch 118 capable of detecting whether a developing replenisher corresponding to a quantity or volume exceeding a predetermined first specified quantity remains within the replenishing tank 112, is provided at a middle position of the replenishing tank 112 as seen in the vertical direction in FIG. 3. Therefore, the float switch 118, which serves as a sensor, can detect a level of the developing replenisher in the replenishing tank 112.

On the other hand, the replenishing pump 116 and the float switch 118 are electrically connected to a control device 120. Therefore, the control device 120 can verify the quantity of developing replenisher delivered to the developing bath 74 based on the amount of rotation of The rotatable shaft of the replenishing pump 116, which is detectable from a time interval required for the AC motor to rotate. Further, the control device 120 can recognize the remaining quantity of developing replenisher based on a level detection signal generated from the float switch 118.

Further, the control device 120 is electrically connected to a monitor 122 (also shown in FIG. 2) which is used as a display unit and is provided so as to be able to display a message indicative of the supply of the developing replenisher to each replenishing tank 112 on the monitor 122.

Here, for example, about 3.5 liters are considered as the total quantity of the replenishing tanks 112. Further, a liquid level detectable by the float switch 118 is set as a position indicated by a dotted line ①. A volume X, which is defined within the replenishing tank 112 on the upper side as seen from the dotted line ①, is considered to be about 1.2 liters.

Further, about 1.8 liters are considered as a volume $\alpha$ defined between the liquid level indicated by the dotted line ① and a dotted line ② set as a liquid level for urging an operator to supplement the developing replenisher to each replenishing tank 112.

Furthermore, about 0.4 liters, which can be defined in advance as a normal, one-day processing quantity or volume, is considered as a quantity $\beta$ defined between the liquid level indicated by the dotted line ② and a dotted line ③ set as a liquid level corresponding to a lower limit of a usable developing replenisher. 0.4 liters referred to above is defined as a second specified volume. About 0.1 liters is considered as a volume 7 formed within the replenishing tank 112 on the lower side as seen from the dotted line ③.

Namely, the float switch 118 is provided so as to be able to detect the liquid level of the developing replenisher when a residual quantity obtained by adding the volume $\alpha$ and the volume $\beta$, which is of a processing quantity or volume larger than the quantity $\beta$ corresponding to the normal, one-day processing volume, exists. It is thus understood that when the residual developing replenisher in the replenishing tank 112 is detected by the float switch 118, a developing replenisher of a quantity far larger than the one day's processing quantity still remains.

Incidentally, the second specified volume is set to about 0.4 liters because 30 rolls of 24 exposure negative film N are normally printed as a printing workload per day and the quantity of a developing replenisher to be used, which corresponds to an area of photographic paper P necessary for printing the 30 rolls of 24 exposure negative film N is brought to about 0.4 liters. The processing volume in the printer-processor 10 is recognized by counting the number of image frames on the negative film N, for example. Further, information about the processing volume is sent to the control device 120, which estimates the degree of progress of development made with the photographic paper P and the quantity of the developing replenisher used in the developing bath 74.

When the developing bath 74 is replenished with the developing replenisher in the replenishing tank 112 and the replenishing tank 112 runs low of developing replenisher, a developing replenisher is poured into a supply port 112B defined in an upper portion of the replenishing tank 112 from a bottle 130 (shown in FIG. 5) for supplying the developing replenisher, which contains a developing replenisher of about 2.5 liters, for example.

The operation of the present embodiment will now be described.

When photographic paper P is subjected to development in the developing bath 74, the rotatable shaft of the replenishing pump 116 is rotated in unison with this development in order to feed the developing replenisher temporarily stored in the replenishing tank 112 to the developing bath 74, thereby refilling the developing bath 74 with a developing replenisher corresponding to a quantity used and depleted for development processing in the developing bath 74. At this time, the float switch 118 detects whether the developing replenisher corresponding to a quantity exceeding the liquid level indicated by the dotted line ① still remains within the replenishing tank 112 as shown in FIG. 3. Since the developing replenisher is successively added to the developing bath 74 as development processing in the developing bath 74 proceeds, the liquid level in the replenishing tank 112 is lowered.

Figure 4:
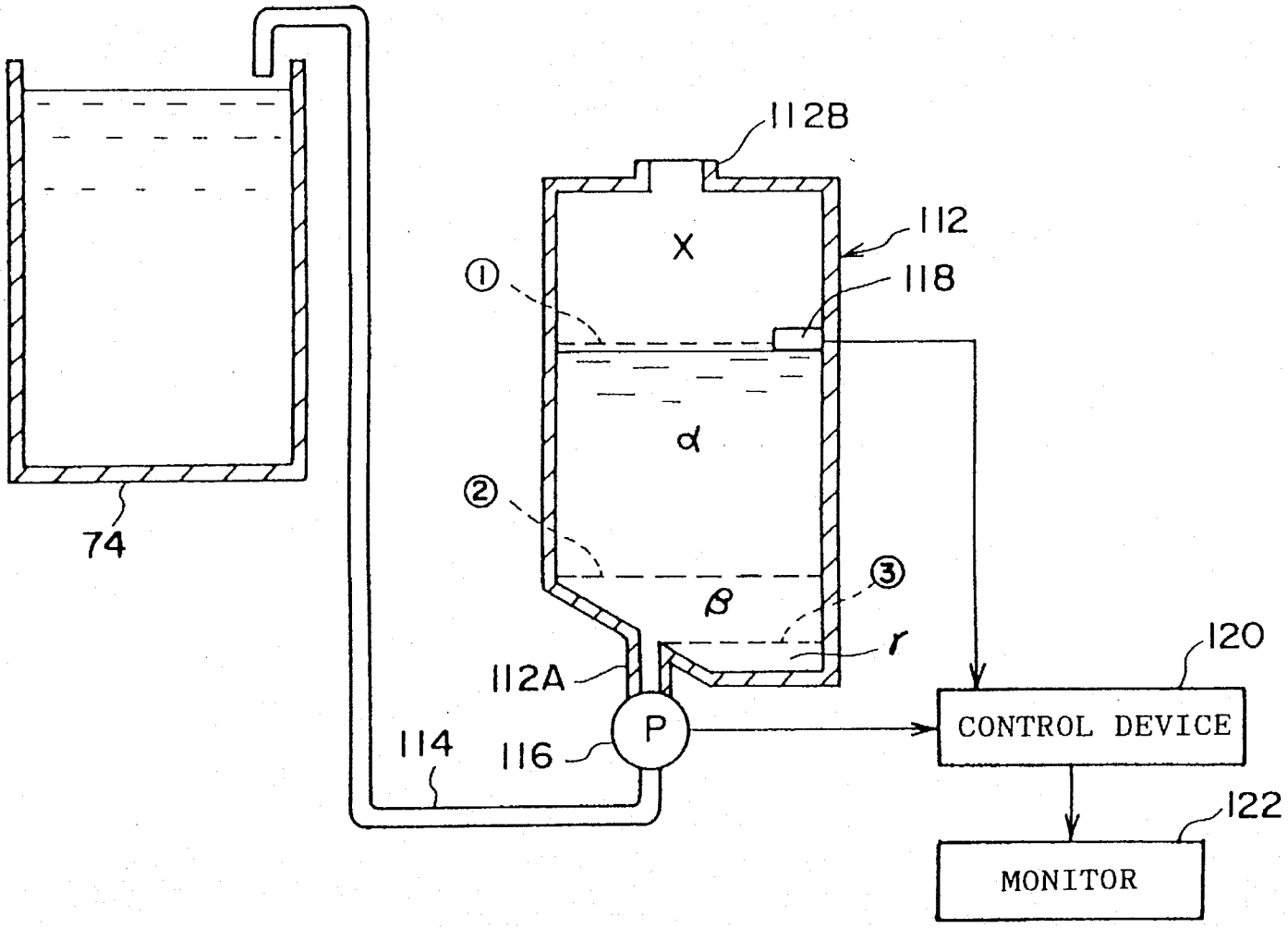
FIG. 4 is a view schematically depicting the structure of the replenishing device shown in FIG. 3 and is a view showing a state in which a liquid level is located between the dotted line ① and a dotted line ②.
Figure 5:
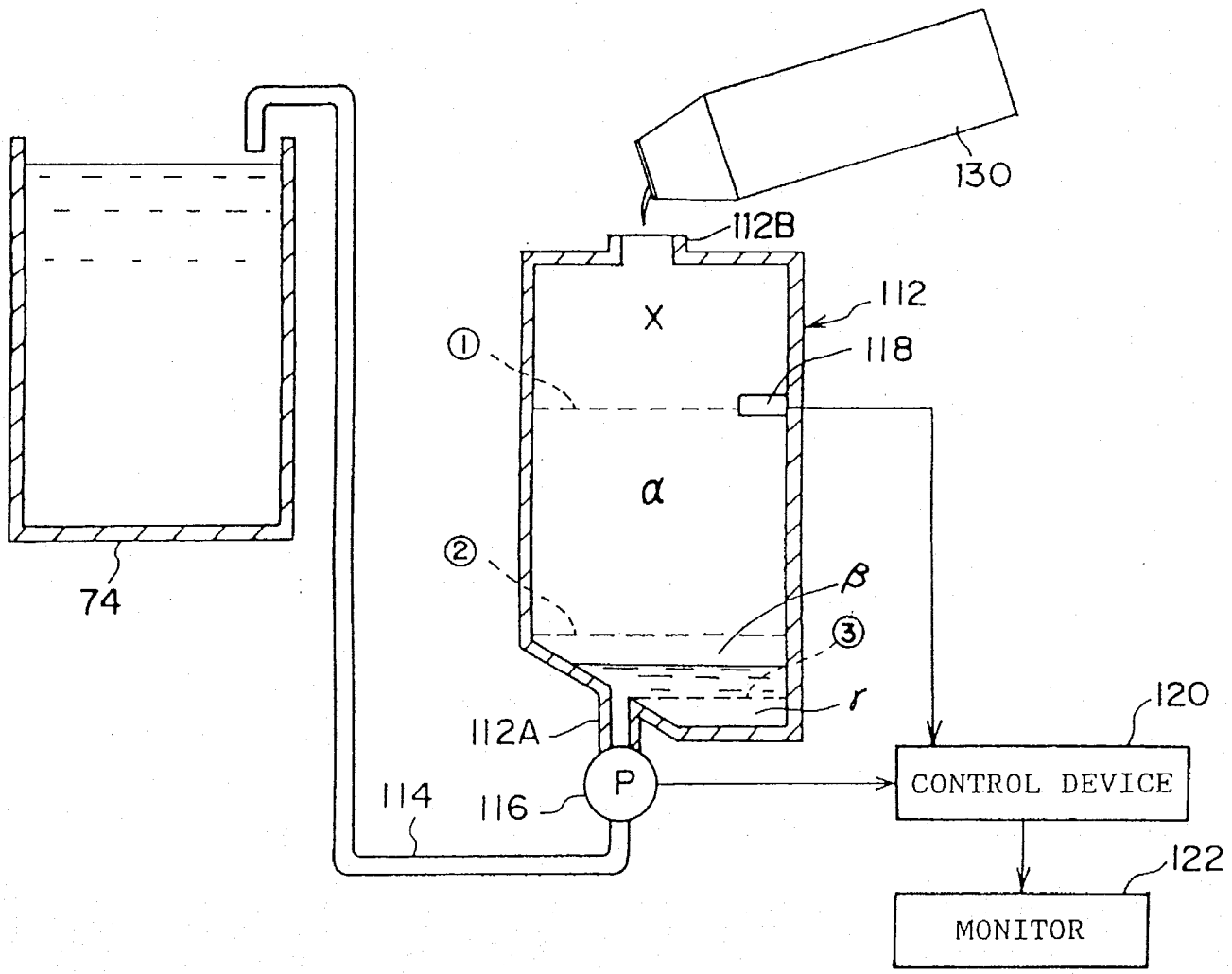
FIG. 5 is a view schematically illustrating the structure of the replenishing device shown in FIG. 3 and is a view showing a state in which a liquid level is located below the dotted line ②.

Further, when the float switch 118 detects that the level of the developing replenisher has been brought to a level that is not greater than the liquid level indicated by the dotted line ① as shown in FIG. 4, the control device 120 measures a time interval necessary for the AC motor to rotate the rotatable shaft of the replenishing pump 116 and counts the total quantity of developing replenishers supplied to the developing bath 74 subsequently, based on the measured time interval. When development processing is performed without interruption after the control device 120 has made a judgment based on the counted quantity that the remaining developing replenisher has been brought to a level that is less than the liquid level indicated by the dotted line ② as shown in FIG. 5, the control device 120 judges that the residual quantity has reached the liquid level or less indicated by the dotted line ② and allows the monitor 122 to display instructions for supplying the developing replenisher to each replenishing tank 112. Namely, for example, after one day's development processing has finished or when development processing prior to the initiation of development processing to be made on the following day is performed without interruption, the control device 120 causes the monitor 122 to display developing-replenisher supply instructions.

Thus, when the normal, one-day processing quantity is a predetermined quantity or less, the liquid level exists between the dotted line ② and the dotted line ③ whose level therebetween corresponds to a level of a predetermined quantity to a level before the developing replenisher in each replenishing tank 112 becomes empty, and development processing is not interrupted, an operator, via the monitor 122, recognizes the need to supply the developing replenisher to the corresponding replenishing tank 112. Accordingly, the operator recognizes that supplying the developing replenisher to the replenishing tank 112 by using the bottle 130 improvement will be made. This results in a reduction of interruptions in the development processing and an improvement in work efficiency.

Namely, even when the control device 120 can easily judge that the remaining quantity of developing replenisher in the replenishing tank 112 is less than the liquid level indicated by the dotted line ②, the instructions for supplying the developing replenisher to the replenishing tank 112 are not displayed on the monitor 122 during the development processing. Upon daily inspection prior to the initiation of development processing after turning the power of the printer-processor 10 on the next day, for example, the control device 120 makes another decision regarding the liquid level and enables the monitor 122 to display developing-replenisher supply instructions.

Operations and effects for detecting failures produced in the replenishing device according to the present embodiment will now be described.

When the development of the photographic paper P in the developing bath 74 proceeds as described above, the level of the developing replenisher in the replenishing tank 112 is lowered if the replenishing pump 116 and the float switch 118 are in normal operation. Thus, the float switch 118 detects that the developing replenisher has reached less than the liquid level indicated by the dotted line ① as shown in FIG. 4.

When, however, the control device 120 estimates, based on information concerning the degree of development processing to the photographic paper P with images on the negative film N printed thereon, that the remaining quantity of developing replenisher reaches less than the liquid level indicated by the dotted line ①, but the float switch 118 has not detected such an occurrence, the float switch 118 is considered not to detect the remaining developing replenisher due to failures in the replenishing pump 116 or the float switch 118. In this case, the control device 120 causes the monitor 122 to display the result of non-detection of a reduced level in the developing replenisher. Accordingly, the operator can recognize that the developing replenisher is not yet supplied to the developing bath 74 due to the failures in the replenishing pump 116 or the float switch 118.

Further, when the control device 120 estimates that the remaining quantity of developing replenisher becomes less than the liquid level indicated by the dotted line ② as shown in FIG. 5 after the development of the photographic paper P in the developing bath 74 has proceeded, the control device 120 causes the monitor 122 to display the instructions for supplying the developing replenisher to the corresponding replenishing tank 112 as described above. Accordingly, the operator supplies the developing replenisher to the replenishing tank 112 from the bottle 130 in accordance with the instructions referred to above.

When, at this time, the replenishing pump 116 is faulty, for example, the developing replenisher is not supplied to the developing bath 74 due to the failure and the level of the developing replenisher exists between the liquid level indicated by the dotted line ① and the liquid level indicated by the dotted line ②, the developing replenisher normally overflows the replenishing tank 112 as a developing replenisher of 2.5 liters is additionally supplied from the bottle 130. Therefore, the operator can confirm the failure of the replenishing pump 116 due to the overflow of the developing replenisher.

On the other hand, even when the level of the developing replenisher is less than the liquid level indicated by the dotted line ② as shown in FIG. 5, the replenishing pump 116 can be considered to be faulty.

Namely, in order to prevent development processing prior to the initiation of one day's development processing, for example, so as not to interrupt operation, the control device 120 judges that the remaining quantity of developing replenisher has been brought to a level that is less than the liquid level indicated by the dotted line ②. Therefore, there is often a case in which the residual developing replenisher is reduced rather lower than the liquid level indicated by the dotted line ② and the replenishing pump 116 develops trouble in the course of its reduction.

In this case, a space for storing developing replenisher which is 2.5 liters or more therein exists within the replenishing tank 112. All the developing replenisher in the bottle 130 is poured into the corresponding replenishing tank 112 regardless of whether the replenishing pump 116 is faulty. Thus, the developing replenisher is prevented from overflowing the replenishing tank 112. Even in this case, however, the float switch 118 does not detect the remaining quantity of developing replenisher when the development processing is continued after the supply of the developing replenisher to the replenishing tank 112. Therefore, the monitor 122 displays the result of the non-detection of a reduction in the developing replenisher to enable the operator to recognize that the developing replenisher is not being supplied to the developing bath 74 due to the failures in the replenishing pump 116 in the same manner as described above.

Thus, the operator can find the failures in the replenishing pump 116 from the fact that the developing replenisher has not been supplied to the developing bath 74. Therefore, the failures in the replenishing pump 116 can be detected early at low cost without using a number-of-revolutions detector such as an expensive rotary encoder or the like.

Figure 6:
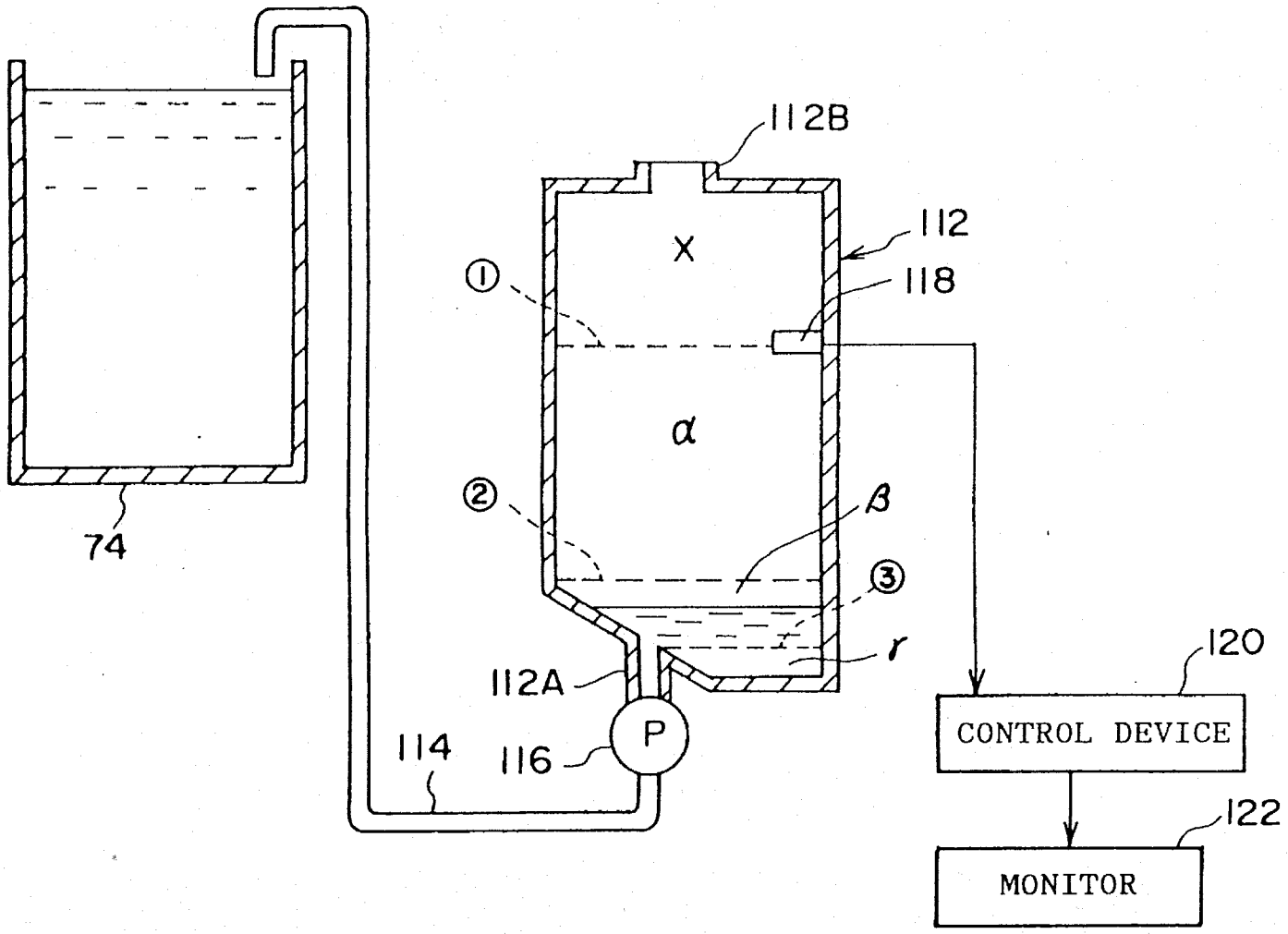
FIG. 6 is a view schematically showing the structure of a modification of the replenishing device shown in FIG. 3 and is a view illustrating a state in which a liquid level is located above the dotted line ①).

In the illustrated embodiment, the control device 120 and the replenishing pump 116 are electrically connected to each other but may not be connected to each other as illustrated in FIG. 6. Since the operator can recognize the non-delivery of the developing replenisher to the developing bath 74 even in this case, the failures in the replenishing pump 116 can be detected early at low cost.

In the illustrated embodiment as well, when development processing remains uninterrupted after the control device 120 has judged that the remaining quantity of developing replenisher has reached a level that is less than the liquid level indicated by the dotted line ②, the control device 120 determines that the residual developing replenisher has been brought to a level that is less than the liquid level indicated by the dotted line ② and causes the monitor 122 to display the instructions for the supply of the developing replenisher to the replenishing tank 112. However, although the above decision is always made by the control device 120, the control device 120 may cause the monitor 122 to display the instructions for the supply of the developing replenisher to the replenishing tank 112.

Further, the aforementioned embodiment has been described using the developing bath 74. However, even when the bleaching/fixing bath 76 and the washing baths are respectively replenished with the processing solutions, they are refilled with the processing solutions in the same manner as described above although the processing bath and the replenishing tank are different in quantity or the like.

In order for the two types of processing solutions to be mixed within the bleaching/fixing bath 76 during the bleaching/fixing process, there are two replenishing tanks. The bleaching/fixing bath 76 is simultaneously replenished with the processing solutions from the two replenishing tanks. Accordingly, float switches cannot simultaneously detect liquid levels within the two replenishing tanks due to, for example, a difference between quantities of developing replenishers to be fed from replenishing pumps. In this case, however, when the float switch provided in one of the replenishing tanks detects the liquid level, the replenishing pump on the other replenishing tank side is activated until the other float switch detects the liquid level, so as to align the liquid levels with each other. Subsequent operation is performed in the same manner as the aforementioned embodiment.

Furthermore, the monitor 122 is used as the display unit in the aforementioned embodiment. However, a warning device may be used as the display unit so as to produce an alarm and thereby provide a display of a visual alarm. For example, a microcomputer or the like can be considered as the control device 120. However, the control device 120 may be other control devices or may be combined with a controller for the density measuring unit 40.

Still further, the aforementioned embodiment has been described using liquid developing replenisher as a processing chemical. However, the replenishing processing chemical employed in the present invention may include a tablet, a powder or the like.

As has been described above, the replenishing device according to the present invention can bring about an excellent effect in that interruptions of development processing is reduced and work efficiency is improved. Further, the replenishing device and the method of detecting the failures produced in the replenishing device can bring about an excellent effect in that the failures in the replenishing pump can be detected at low cost.

Having now fully described the invention, it will be apparent to those skilled in the art that many changes and modifications can be made without departing from the spirit or scope of the invention as set forth herein.

What is claimed is:

1. A replenishing device comprising:

a replenishing tank for temporarily storing therein a replenishing processing chemical available for replenishing development processing in a processing bath;

replenishing means for replenishing a replenishing processing chemical to the processing bath from said replenishing tank so as to replenish the processing bath with a replenishing processing chemical commensurate in quantity with a processing chemical used within the processing bath;

a sensor for detecting whether a replenishing processing chemical corresponding to a quantity exceeding a predetermined first specified quantity remains within said replenishing tank;

a display unit capable of displaying instructions for supplying the replenishing processing chemical to said replenishing tank; and a control device for allowing said display unit to display the instructions thereon when said control device judges, based on information provided by said replenishing means indicating a quantity of a replenishing processing chemical added to the processing bath after said sensor has detected that a remaining quantity of the replenishing processing chemical has been brought to a level that is less than the first specified quantity, that the remaining quantity of the replenishing processing chemical in said replenishing tank is less than a second specified quantity predetermined to be less than the first specified quantity.

2. A replenishing device according to claim 1, wherein said sensor is a float switch for detecting a level of a replenisher corresponding to the replenishing processing chemical and sending a signal indicative of the detected level to said control device.

3. A replenishing device according to claim 1, wherein said display unit is a monitor for displaying the instructions on a screen thereof.

4. A replenishing device according to claim 1, wherein said display unit is a warning device for producing an alarm to provide instructions for supplying a replenishing processing chemical to said replenishing tank.

5. A replenishing device comprising:

a replenishing tank for temporarily storing therein a replenishing processing chemical available for replenishing development processing in a processing bath;

replenishing means for replenishing a replenishing processing chemical to the processing bath from said replenishing tank so as to replenish the processing bath with a replenishing processing chemical commensurate in quantity with a processing chemical used within the processing bath;

a sensor for detecting whether a replenishing processing chemical corresponding to a quantity exceeding a predetermined first specified quantity remains within said replenishing tank, said sensor is provided within said replenishing tank so that the first specified quantity is set as a value larger than a normal, one day processing quantity;

a display unit capable of displaying instructions for supplying the replenishing processing chemical to said replenishing tank; and a control device for allowing said display unit to display the instructions thereon when said control device judges, based on a quantity of a replenishing processing chemical added to the processing bath after said sensor has detected that a remaining quantity of the replenishing processing chemical has been brought to a level that is less than the first specified quantity, that the remaining quantity of the replenishing processing chemical in said replenishing tank is less than a second specified quantity predetermined to be less than the first specified quantity.

6. A replenishing device comprising:

a replenishing tank for temporarily storing therein a replenishing processing chemical available for replenishing development processing in a processing bath;

replenishing means for replenishing a replenishing processing chemical to the processing bath from said replenishing tank so as to replenish the processing bath with a replenishing processing chemical commensurate in quantity with a processing chemical used within the processing bath, said replenishing means being a pump having a rotatable shaft which is rotated by a motor;

a sensor for detecting whether a replenishing processing chemical corresponding to a quantity exceeding a predetermined first specified quantity remains within said replenishing tank;

a display unit capable of displaying instructions for supplying the replenishing processing chemical to said replenishing tank; and a control device for allowing said display unit to display the instructions thereon when said control device judges, based on a quantity of a replenishing processing chemical added to the processing bath after said sensor has detected that a remaining quantity of the replenishing processing chemical has been brought to a level that is less than the first specified quantity, that the remaining quantity of the replenishing processing chemical in said replenishing tank is less than a second specified quantity predetermined to be less than the first specified quantity.

7. A replenishing device comprising:

a replenishing tank for temporarily storing therein a replenishing processing chemical available for replenishing development processing in a processing bath;

replenishing means for replenishing a replenishing processing chemical to the processing bath from said replenishing tank so as to replenish the processing bath with a replenishing processing chemical commensurate in quantity with a processing chemical used within the processing bath;

a sensor for detecting whether a replenishing processing chemical corresponding to a quantity exceeding a predetermined first specified quantity remains within said replenishing tank;

a display unit capable of displaying instructions for supplying the replenishing processing chemical to said replenishing tank; and a control device for allowing said display unit to display the instructions thereon when said control device judges, based on a quantity of a replenishing processing chemical added to the processing bath after said sensor has detected that a remaining quantity of the replenishing processing chemical has been brought to a level that is less than the first specified quantity, that the remaining quantity of the replenishing processing chemical in said replenishing tank is less than a second specified quantity, predetermined to be less than the first specified quantity, and when development processing in said processing bath has been completed.

8. A replenishing device comprising:

a replenishing tank for temporarily storing therein a replenishing processing chemical available for replenishing development processing in a processing bath;

replenishing means for replenishing a replenishing processing chemical to the processing bath from said replenishing tank so as to replenish the processing bath with a replenishing processing chemical commensurate in quantity with a processing chemical used within the processing bath;

a sensor for detecting whether a replenishing processing chemical corresponding to a quantity exceeding a predetermined first specified quantity remains within said replenishing tank;

a display unit capable of displaying instructions for supplying the replenishing processing chemical to said replenishing tank; and a control device for allowing said display unit to display the instructions thereon when upon initiation of development processing, said control device judges, based on a quantity of a replenishing processing chemical added to the processing bath after said sensor has detected that a remaining quantity of the replenishing processing chemical has been brought to a level that is less than the first specified quantity, that the remaining quantity of the replenishing processing chemical in said replenishing tank is less than a second specified quantity predetermined as a normal, one-day processing quantity.

9. A replenishing device according to claim 8, wherein said sensor is provided within said replenishing tank so that the first specified quantity is set as a value larger than the normal, one-day processing quantity.

10. A replenishing device comprising:

a replenishing tank for temporarily storing therein a replenishing processing chemical available for replenishing development processing in a processing bath;

replenishing means for replenishing a replenishing processing chemical to the processing bath from said replenishing tank so as to replenish the processing bath with a replenishing processing chemical commensurate in quantity with a processing chemical used within the processing bath;

a sensor for detecting whether a replenishing processing chemical corresponding to a quantity exceeding a predetermined first specified quantity remains within said replenishing tank;

a display unit capable of displaying instructions for supplying the replenishing processing chemical to said replenishing tank; and a control device for allowing said display unit to display the instructions thereon when said control device stores a total quantity of replenishing processing chemical replenished by said replenishing means after said sensor has detected that a remaining quantity of the replenishing processing chemical in said replenishing tank has been brought to a level that is less than the first specified quantity, recognizes the residual replenishing processing chemical in said replenishing tank and judges that the remaining quantity of the replenishing processing chemical is less than a second specified quantity predetermined so as to become less than the first specified quantity.

11. A replenishing device according to claim 10, wherein said replenishing means is a pump having a rotatable shaft which is rotated by a motor and said control device measures a time required to drive and rotate the motor to recognize the remaining quantity of the replenishing processing chemical when said control device stores the total quantity of replenishing processing chemical and recognizes the residual replenishing processing chemical in said replenishing tank.

12. A replenishing device according to claim 10, wherein when the remaining quantity of the replenishing processing chemical in said replenishing tank is less than the second specified quantity, said control device allows said display unit to display the instructions for the supply of the replenishing processing chemical to said replenishing tank upon completion of development processing in the processing bath.

13. A replenishing device comprising:

a replenishing tank for temporarily storing therein a replenishing processing chemical available for replenishing developing processing in a processing bath;

replenishing means for supplying a replenishing processing chemical to the processing bath from said replenishing tank so as to replenish the processing tank with a replenishing processing chemical of a quantity required to recover a processing chemical used and depleted within the processing bath;

a sensor capable of detecting that a remaining quantity of the replenishing processing chemical in said replenishing tank has reached a predetermined first specified quantity;

a display unit capable of displaying non-detection of a reduction in the replenishing processing chemical and instructions for supplying the replenishing processing chemical to said replenishing tank; and a control device for allowing said display unit to display the non-detection of the reduction in the replenishing processing chemical thereon where said sensor does not detect the remaining quantity of the replenishing processing chemical when said control device estimates, based on a quantity of a replenishing processing chemical for supplementing depletion of a processing chemical according to a quantity of a processing chemical for development processing of a photosensitive material in the processing bath, that the remaining quantity of the replenishing processing chemical is less than the first specified quantity and for allowing said display unit to display the instructions thereon when said control device estimates, based on a quantity of a subsequent replenishing processing chemical for supplementing depletion of the processing chemical according to a quantity of a processing chemical for development processing of the photosensitive material in the processing bath, that the remaining quantity of the replenishing processing chemical in said replenishing tank is less than a second specified quantity predetermined so as to become less than the first specified quantity.

14. A replenishing device according to 13, wherein said replenishing means is a pump having a rotatable shaft which is rotated by a motor.

15. A replenishing device according to claim 13, wherein said sensor is a float switch for detecting a level of a replenisher corresponding to the replenishing processing chemical and sending a signal indicative of the detected level to said control device.

16. A replenishing device according to claim 13, wherein said display unit is a monitor and is capable of displaying a result of non-detection of a reduction in the replenishing processing chemical by said sensor on a screen of the monitor where said sensor does not detect a residual replenishing processing chemical when said control device estimates that the remaining quantity of the replenishing processing chemical is less than the first specified quantity.

17. A replenishing device according to claim 13, wherein said display unit is a warning device and is capable of displaying a result of non-detection of a reduction in the replenishing processing chemical by said sensor, using an alarm produced from the warning device where said sensor does not detect a residual replenishing processing chemical when said control device estimates that the remaining quantity of the replenishing processing chemical is less than the first specified quantity.

18. A method of detecting failures in a replenishing device for replenishing a replenishing processing chemical from a replenishing tank storing the replenishing processing chemical therein to a processing bath by replenishing means so as to replenish the processing bath with a replenishing processing chemical commensurate with a quantity for recovering depletion of a processing chemical used within the processing bath, said method being suitable for use in said replenishing device, comprising the steps of:

detecting, based on a quantity of a replenishing processing chemical for supplementing depletion of a quantity of a processing chemical used for development processing of a photosensitive material in the processing bath, whether the replenishing processing chemical stored in said replenishing tank is reduced to a level that is less than a first specified quantity; and displaying information about a residual replenishing processing chemical in said replenishing tank, which is reduced to less than a second specified quantity, when it is estimated, based on information provided by said replenishing means representing a subsequent quantity of said replenishing processing chemical which supplements depletion of said processing chemical in the processing bath, that the remaining quantity of the residual replenishing processing chemical is less than the second specified quantity predetermined to be less than the first specified quantity.

19. A method according to claim 18, wherein when detection is made as to whether the replenishing processing chemical in the replenishing tank is reduced to less than the first specified quantity, a level detecting float switch is able to detect a result that the replenishing processing chemical has been brought to the first specified quantity.

20. A method of detecting failures in a replenishing device for replenishing a replenishing processing chemical from a replenishing tank storing the replenishing processing chemical therein to a processing bath by replenishing means so as to replenish the processing bath with a replenishing processing chemical commensurate with a quantity for recovering depletion of a processing chemical used within the processing bath, said method being suitable for use in said replenishing device, comprising the steps of:

detecting, based on a quantity of a replenishing processing chemical for supplementing depletion of a quantity of a processing chemical used for development processing of a photosensitive material in the processing bath, whether the replenishing processing chemical stored in said replenishing tank is reduced to a level that is less than a first specified quantity; and displaying information about a residual replenishing processing chemical in said replenishing tank, which is reduced to less than a second specified quantity, when it is estimated, based on a subsequent quantity of said replenishing processing chemical which supplements depletion of said processing chemical in the processing bath, that the remaining quantity of the residual replenishing processing chemical is less than the second specified quantity predetermined to be less than the first specified quantity, and when a reduction in the replenishing processing chemical is not detected, a result of non-detection of the reduction in the replenishing processing chemical is displayed on a screen of a monitor.

* * * * *